United States Patent [19]

Hopkins

[11] 3,998,352

[45] Dec. 21, 1976

[54] ATTACHMENT FOR RIMS OF PAINT CANS OR THE LIKE

[76] Inventor: Jeffrey E. Hopkins, 78 Fairfield Ave., Danville, Va. 24541

[22] Filed: Jan. 14, 1976

[21] Appl. No.: 649,046

[52] U.S. Cl. ..... 220/90; 248/110

[51] Int. Cl.[2] ..... B65D 25/00; A46B 17/02

[58] Field of Search ..... 220/90, 354; 248/110, 248/112

[56] References Cited

UNITED STATES PATENTS

| | | | |
|---|---|---|---|
| 820,081 | 5/1906 | Alley et al. | 220/90 |
| 2,196,614 | 4/1940 | Spitz | 220/90 |
| 2,534,964 | 12/1950 | Frank | 220/90 |
| 2,639,835 | 5/1953 | Nelson | 220/90 |
| 3,744,671 | 7/1973 | Saunders, Jr. | 220/90 |

*Primary Examiner*—William Price

*Assistant Examiner*—Steven M. Pollard

[57] ABSTRACT

A shield is snap fit onto the upper rim of a conventional paint can and serves the dual purpose of providing a place for scraping excess paint from a paint brush as it is withdrawn from the paint can and at the same time, preventing the removed paint from running down the sides of the can and getting into the upper channel or groove. Structurally, the device includes an annular shield member having depending snap attachment means for releasably attaching the shield to the upper rim of the can and a pair of vertically and horizontally spaced, annular wire scraping members supported above the upper surface of the shield against which the brush is pressed to remove excess paint therefrom.

2 Claims, 2 Drawing Figures

ATTACHMENT FOR RIMS OF PAINT CANS OR THE LIKE

BACKGROUND OF THE INVENTION

One of the long existing nuisances for painters, and particularly painters of less expertise than others, is that the upper rim of the paint can, which conventionally includes an annular channel for receiving the lid, soon becomes filled with paint making replacement and removal of the lid extremely difficult. Additionally, overflow paint runs down the sides of the can to the bottom, where it flows onto any surface on which the can may be resting.

Some attempts have been made to alleviate this problem as evidenced by the U.S. Pat. Nos. 3,744,671; 3,727,792; and 3,469,735. Such attempts, while protecting the rim of the paint can sufficiently enough by a covering member or shield, have provided less than satisfactory wiper or skimmer elements for removing the paint. One of the problems is to quickly remove the fresh paint from the skimming element, so that paint will not build up thereon and it will be relatively free of paint by the time the brush is again pressed against it for a successive skimming operation.

Further, in the skimming operation with some known shield members, where the brush is actually moved against the main portion of the shield, paint is caused to flow back beneath the lip of the shield into the rim of the can, or else to flow down the outside portion of the shield and get on the outside of the paint can, from whence the paint flows down onto the surface supporting the can.

SUMMARY OF THE INVENTION

The present invention, on the other hand, is directed to an improved protective shield for paint cans of the conventional type, which not only adequately protects the upper channel of the rim of the can, but also provides a plurality of discrete, spaced, wipers or skimming elements. These wipers in the present invention are spaced apart sufficiently, and from the shield a distance which prevents paint buildup therebetween and between the wipers and the shield, which results in an improved skimming device.

The skimming device of the present invention is quickly snapped into place around the channeled rim and remains rigidly in position until removal is desired. The amount of paint remaining on and drying on the skimming element is kept to a minimum thereby preventing excessive waste of paint. Additionally, the wire-type wipers are so positioned with relation to each other and with relation to the shield that, as the paint brush is normally removed from the paint can, the brush may be first brought into contact with one, then the next wiper without engaging the shield, and without any strange contortions. Further a desired amount of paint is removed in one passage across the wipers without necessitating repeated swipes thereacross.

With the aforementioned problems in mind, it is therefore an object of the present invention to provide an improved shield for the upper rim of paint cans which includes therewith an efficient and improved skimming means.

It is a further object of the present invention to provide a shield for paint cans of the type described in which a pair of wire-like wipers are strategically formed and positioned as to remove a prescribed amount of paint from the brush with the least amount of effort.

Another object of the present invention is to provide a protective shield of the type described which is easily emplaced and removed from the paint can.

With these objects in mind, a fuller understanding of the present invention may be attained by reading the following detailed disclosure of a preferred embodiment in view of the accompanying drawings in which.

Figure 1:
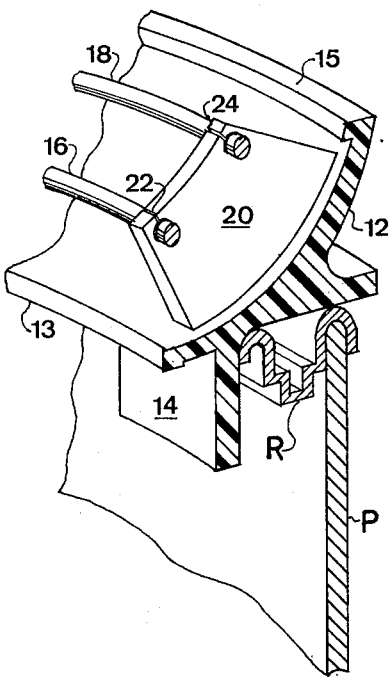
FIG. 1 is an enlarged, partial sectional view taken substantially in the plane of the section lines 1—1 of FIG. 2, and including a cross-sectional portion of the rim of a container.
Figure 2:
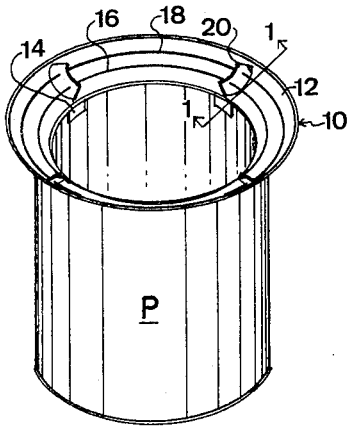
FIG. 2 is a perspective environmental showing of a paint can having the safety shield according to the present invention assembled thereon.

Turning now to the drawings, there is illustrated in FIG. 1, a conventional paint can P of the type having a channeled groove or rim R extending annually about the upper edge thereof which receives a lid (not shown) having a correspondingly shaped downwardly extending bead which fits into the channel within the rim R. It is this rim R which normally accumulates paint as the brush is wiped against the edge of the rim. As the paint dries after the lid has been replaced, it then becomes difficult to reopen the paint can. Eventually, the paint will build up to such an extent it is even difficult to replace the lid thereon.

It is for the conventional type of paint can P described hereinabove, that the protective attachment 10 of the present invention is designed. As envisioned, the protective device may be made out of any desirable material, however it is contemplated that one of the commercially available plastic materials will suffice and provide a long lasting, sufficiently strong material to support the hereinafter described wiper elements 16,18, which in themselves may be formed either of wire rods bent into a circular arrangement, or could also be formed of plastic material.

An annular shaped shield or protective member 12 having a curved cross-sectional shape is snap fit onto the upper rim R by means of a plurality of spaced, resilient tabs 14 which depend downwardly from the shield 12 and which have an outer diameter slightly greater than the inner diameter formed by the rim R. Such tabs or any other similar, suitable attachment means are used to releasably mount the protective device upon the can P. The inner diameter of the annular protective shield 12 is such that the inner peripheral edge 13 overlaps and extends inwardly over the inner periphery of the upper rim R, so that paint which runs down the shield 12 will drop back into the can, rather than running down the sides thereof or working its way back up under the shield 12 into the channel in rim R. Similarly, the outer edge 15 of shield member 12 is of a diameter greater than the outermost diameter of the paint can P, so that paint droppings from the brush cannot fall into the rim R of the can P.

A first, inner wiper skimming means 16 is formed by an annular shaped wire member which is so dimensional and positioned as to lie approximately ½ inch above the surface of shield 12. The diameter of the first skimming element 16 is such, and it is so positioned that as a paint brush is removed from the can, it may be easily manipulated to engage the first wiper element 16, rather than the inner edge 13 of shield 12.

A second wiper or skimming means 18 is also formed of a circular wire member having a diameter approximately ¾ inches greater than the diameter of the first skimming element 16. Further, the second skimming element 18 is so positioned with respect to the surface of shield 12 that it is approximately 1 inch thereabove, or approximately ½ inch further from shield 12 than the first wiper 16. As the paint brush is moved from the paint can it will engage first the wire member 16, and soon thereafter the outer skimming element 18, so that each skimming element provides a relatively narrow surface area which is pressed against the bristles of the brush simultaneously to remove the optimum amount of paint therefrom. It is therefore not necessary to repeat the action against the skimming elements, as one passage thereover will normally suffice for each side of the brush. When the brush is laid against both wipers 16,18, the angle formed thereby is such that the brush will not strike either edge 13 or 15.

A plurality of arcuately spaced mounting bosses 20 are molded into the surface of shield 12, and each boss 20 includes a pair of upwardly facing, snap-in grooves 22,24 into which skimming elements 16,18 respectively may be releasably secured. It is preferable that the skimming elements be releasable or removable from the shield to promote easier and better cleaning after each usage. The number of mounting bosses 20 provided on shield 12 is a matter of preference, and generally three or four will suffice to adequately hold skimming elements 16,18 therein.

It is apparent that various modifications and variations of the present invention would be possible in view of the teaching set forth hereinabove without departing from the scope of the invention, which is to be determined by the following claims.

What is claimed is:

1. A paint shield for releasable attachment to a paint can of the type having a channeled rim around the open top thereof upon removal of the lid, said shield comprising:

a. a molded annular cover plate, when positioned, extending peripherally around said can and radially from a point inside the inner periphery of said rim upwardly and outwardly to a point above and outside the outer periphery of said rim whereby paint deposited thereon is funneled back into said can;

b. a quick release attachment means formed integrally with and extending downwardly from the underside of said cover plate for releasable connection with the rim of said paint can;

c. a plurality of arcuately spaced mounting bosses formed integrally in and extending upwardly from the upper surface of said cover plate, each boss including a pair of grooves therein in vertical and horizontal spaced relation with respect to each other;

d. a first, inner wiper element comprising a ring-shaped wire member inserted in the lowermost of said grooves in a position spaced above said cover plate; and e. a second, outer wiper element comprising an annular wire member formed into a ring of greater diameter than said first wiper element and inserted in the uppermost of said grooves.

2. The shield according to claim 1 wherein said attachment means comprises at least one vertical wall depending from the under surface of said cover plate and including a resilient locking means associated therewith for engaging said rim and preventing inadvertent removal of said cover plate therefrom.

* * * * *